United States Patent [19]

Tupper

[11] Patent Number: 4,470,354

[45] Date of Patent: Sep. 11, 1984

[54] LOAD-TRANSFER DEVICE

[76] Inventor: Alan W. Tupper, The Weavers House, Castle Combe, Wiltshire, SN14 7HX, England

[21] Appl. No.: 379,481

[22] Filed: May 18, 1982

[30] Foreign Application Priority Data

| | | | |
|---|---|---|---|
| Jul. 6, 1981 | [GB] | United Kingdom | 8120839 |
| Aug. 18, 1981 | [GB] | United Kingdom | 8125249 |
| Oct. 6, 1981 | [GB] | United Kingdom | 8130117 |

[51] Int. Cl.[3] ..... B61B 12/02

[52] U.S. Cl. ..... 104/93; 104/115; 104/182; 105/151

[58] Field of Search ..... 104/182, 198, 199, 115, 104/116, 93; 191/76; 105/148, 150, 151

[56] References Cited

U.S. PATENT DOCUMENTS

| | | | |
|---|---|---|---|
| 364,669 | 6/1887 | Prentice | 104/182 |
| 489,234 | 1/1893 | Reutlinger | 191/76 |
| 506,037 | 10/1893 | Forbes | 104/182 |
| 878,653 | 2/1908 | Matthews et al. | 104/182 |
| 904,119 | 11/1908 | Downs | 104/182 |
| 1,106,471 | 8/1914 | Opsal | 104/182 |
| 1,122,024 | 12/1914 | O'Connell | 104/182 |
| 1,429,007 | 9/1922 | Wilson | 104/182 |
| 4,265,179 | 5/1981 | Tupper et al. | 104/182 |

FOREIGN PATENT DOCUMENTS

| | | | |
|---|---|---|---|
| 118065 | 8/1918 | United Kingdom | 104/182 |
| 2024749 | 1/1980 | United Kingdom | 104/182 |

*Primary Examiner*—Randolph Reese
*Assistant Examiner*—Gregory A. Beehner
*Attorney, Agent, or Firm*—Scully, Scott, Murphy & Presser

[57] ABSTRACT

A load-transfer device comprises a pair of rotary members each having an annular series of projecting peg-like elements, and a location member having arcuate tracks in its opposite sides to receive tip portions of the elements respectively. A wire or other elongate element extends beneath the location member and the upright parts of U-shaped clips supporting the wire are received in the spaces between the elements when the device encounters such clips, whereupon the members rotate relative to the location member to permit the clips to pass through the device.

12 Claims, 10 Drawing Figures

23
21
13a
14
22
12
20
32
23
13
16
19
11
18
80

13a
20
19
22
18
16
13

30
31
18

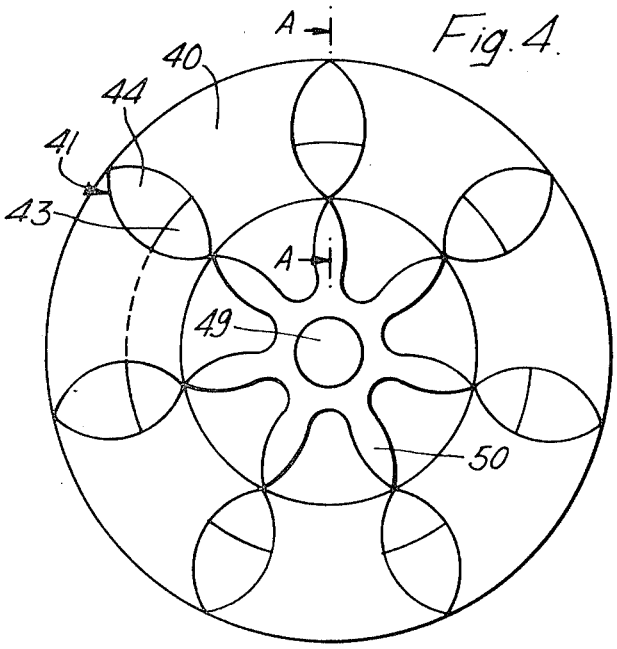
Fig. 4.
Fig. 5.
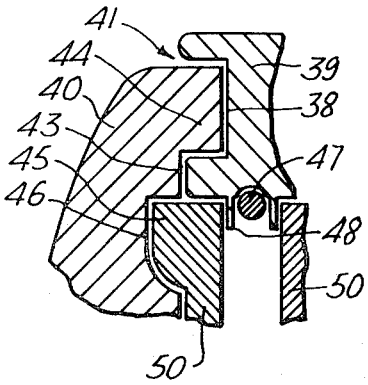

LOAD-TRANSFER DEVICE

FIELD OF AND BACKGROUND TO THE INVENTION

This invention relates to a device for enabling a load to be moved along a path defined by a guide member or a series of guide members, freely past support or attachment points for the guide member or members. Such a device is described in my British Pat. No. 1,582,201 and the present invention provides improvements in, or modifications of, the types of devices disclosed in that British patent.

SUMMARY OF THE INVENTION

According to the invention, there is provided a load-transfer device comprising a pair of rotary members disposed in a spaced apart relationship for rotation about a common axis, each member having an annular series of substantially equally spaced projections extending therefrom towards the other member with each annular series of projections being disposed to encircle the common axis of rotation of the members and a location element having at least a portion thereof disposed between the rotary members, opposite side faces of said portion of the location element being formed with arcuate tracks for receiving and locating the free ends of the projections of the aforesaid series thereof, respectively, the arrangement being such that the rotary members can be rotated about said axis with respect to the location element which is located with respect to the rotary members by said projections which move through said arcuate tracks as the rotary members rotate.

In some embodiments, said projections may be provided by cylindrical elements which are mounted on the rotary members respectively for free rotation so that they act as rolling elements to facilitate movement through the corresponding arcuate tracks on the location element, which are generally provided by arcuate grooves formed in opposite side surfaces thereof. This construction assists in reducing friction between the relatively movable parts of the load-transfer device.

In other embodiments, said projections may be fixed with respect to, or integrally formed with, the respective rotary members and are shaped to have generally convex radial side surfaces. The projections may have the form of a double convex lens, e.g. generally lentil shaped. An advantage of a construction according to this invention for a load-transfer device having projections fixed with respect to their associated rotary members, is that there is a reduction in the force required to rotate the rotary members on engagement of a pair of projections thereof, which move along an arcuate path, by a support or attachment member passing through the device in use and which moves through the device along a generally linear path. This is achieved by replacing the cylindrical projections with projections having radial side surfaces defined by generally arcuate surfaces having a larger radius of curvature.

In use for movement along an elongate element, e.g. a wire, a rope or a rigid rod or tubular member, which is supported by U-shaped suspension elements at spaced locations along its length, the load-transfer device is engaged with the elongate element so that the elongate element extends in the space between the rotary members between the axis of rotation thereof and the location member, generally in sliding contact with the underside of the location member. When the load-transfer device slides along the elongate member and encounters a suspension element thereof, the parallel limbs of the U-shaped element abut portions of respective projections of the rotary members whereby the rotary members rotate with respect to the location element to allow said parallel limbs to pass through the load-transfer device on each side of the location element in spaces defined by adjacent pairs of said projections. When it is necessary to reduce friction between the load-transfer device and the elongate member, rolling element(s) may be provided in the structure of the location member, e.g. as shown in FIG. 8A of my British Pat. No. 1,582,201.

In some embodiments of the invention, the rotary members, which may be generally disc-like elements, may have recesses formed in their peripheries between each pair of adjacent projections thereof to accommodate transverse support elements. Such load-transfer devices can be utilized in an apparatus as described in my published British Patent Specification No. 2,049,592A in which the load-transfer device is engaged with a mesh structure, or in a system as described in my British Patent Specification No. 2,096,957 in which the load-transfer device is engaged with a track defined by a series of transverse, usually rod-like members located at their ends. Reference should be made to the specifications of those specifications for specific details of the constructions disclosed therein.

BRIEF DESCRIPTION OF THE DRAWINGS

FIG. 4 is a side view of one rotary member and a central star wheel of a load-transfer device embodying the invention;

FIG. 5 is a cross-sectional detail of the device of FIG. 4;

DETAILED DESCRIPTION

Figure 1:
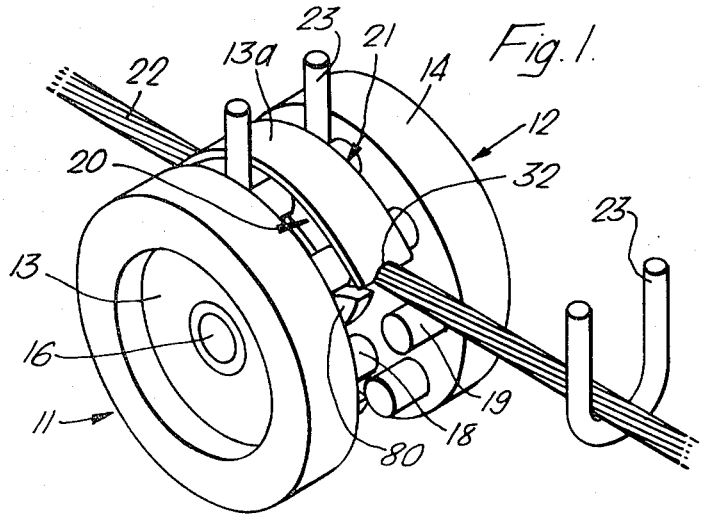
FIG. 1 is a diagrammatic perspective view of a load-transfer device according to the invention engaged with a wire member.
Figure 2:
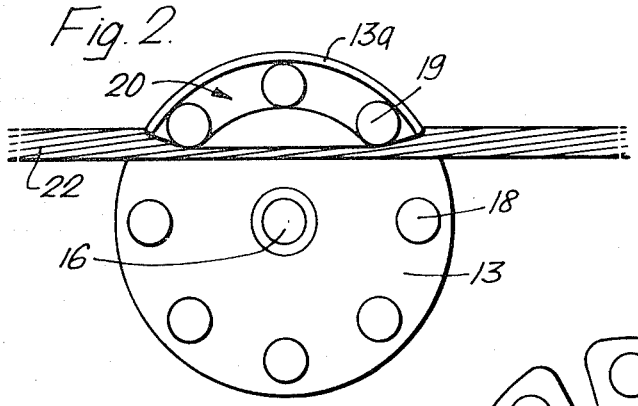
FIG. 2 is a side view of the device of FIG. 1 with one of the disc-like rotary members removed.

Referring to FIGS. 1 and 2, a load-transfer device comprises two wheel members (11 and 12) and a location member (13*a*). Each wheel member (11,12) comprises a disc-like part (13,14) which has a central recessed area on one side thereof so that each member has a relatively thick annular rim portion (15). The wheels are mounted to rotate about a common axle (16).

An annular series of spaced apart cylindrical pegs (18, 19) are located around the rim portion (15) of each member (13,14). End portions of the pegs (18,19) are located in cylindrical recesses provided in the hub portions (15) of the respective members (13,14) in which annular bearing elements are provided. These bearing elements are in most embodiments provided by needle roller bearings but other rolling-type or plain bearings could be provided in further possible embodiments. The pegs could be retained in the recesses by the use of circlips located in peripheral grooves in the pegs to provide an abutment against the inner race of the needle bearings when the pegs are located therein.

The guide member (13*a*), which is positioned between the wheels (13,14) at a peripheral part thereof, is formed with a pair of arcuate recesses (20,21) in opposite side surfaces thereof to receive free end portions of the parts of the pegs (18,19) which project from the wheels (13,14).

In the system shown in FIGS. 1 and 2, the load-transfer device is engaged with a wire element (22) which is suspended by a series of spaced apart U-shaped clips (23). Various methods may be used for locating the elongate element (22) in the load-transfer device. In one possible arrangement shown in FIG. 1, a recessed wheel (80) is mounted on the axle (16) for free rotation. The wheel (80) has a series of regularly spaced radial projections, the tips of which engage the elongate element (22) and locate it against the underside of the guide member (13*a*). The radial projections are preferably smoothly curved to converge towards the tips thereof so that the wheel (80) will be self-indexing to receive the base portion of the clips (23) as they pass through the load-transfer device on engagement of the clips with the projections of the wheel (80) in any angular positions thereof.

A load may be attached to the load-transfer device by any suitable means, for example by using a yoke member which embraces the load-transfer device and is rotatably mounted on extensions of the axle (16). As the load moves, the load-transfer device slides along the wire (22). When it encounters a support clip (23), the parallel arms of the clip are received in spaces between adjacent pairs of pegs (18, 19). On further sliding movement of the load-transfer device along the wire (22), the wheels (11 and 12) rotate with respect to the location member (13*a*) in order to pass the parallel vertical arms of the clip (23) through the device while the wire (22) itself remains in sliding contact with the location member (13*a*). In this way the support clips (23) can be traversed by the load-transfer device without detachment from the wire (22).

Figure 3:
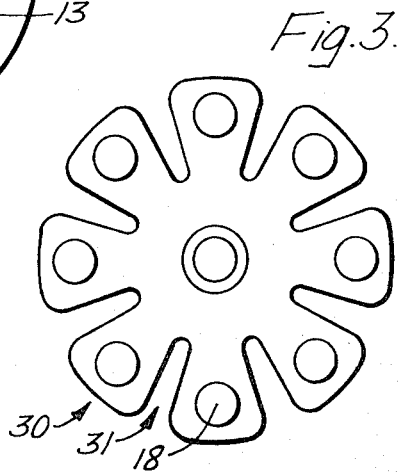
FIG. 3 is an end view of a rotary member of a second embodiment.
Figure 6:
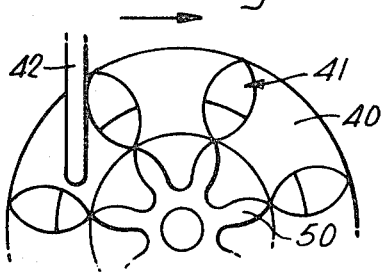
FIGS. 6 to 9 are respective diagrammatic illustrations showing different positions of a support or attachment member passing through the device of FIGS. 4 and 5.
Figure 7:
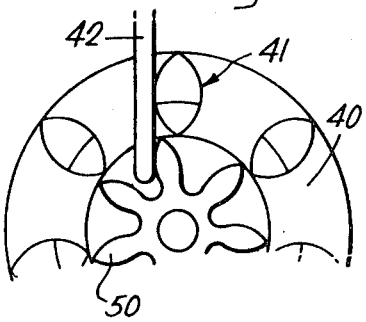
Figure 8:
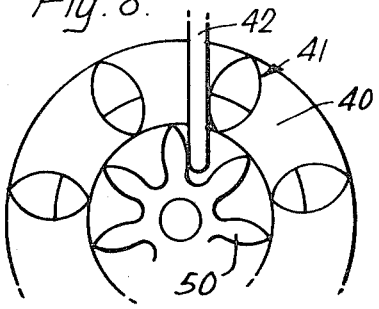
Figure 9:
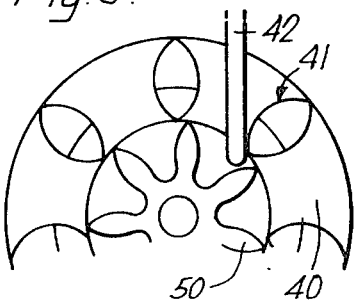

In such a construction friction between the relatively movable parts of the load-transfer device, namely pegs (18) and the location member (13*a*) is minimized by mounting the pegs (18,19) so that they are freely rotatable as they pass through the arcuate raceways provided by recesses (20 and 21) on the location member (13*a*). FIG. 3 shows a modified form of wheel which can be used in a load-transfer device of the type shown in FIG. 1. The wheel (30) is similar to the wheels (11, 12) of FIG. 1 with the exception that a recess (31) is formed in its periphery between each pair of adjacent pegs (18). With this construction support elements for a wire engaged with the device, which extend parallel to the axis of rotation of the wheel (30), can be accommodated in the recesses (31). Furthermore this construction can be used in systems as described in my British Patent Specification No. 2,096,957 in which the load-transfer device moves along a path defined by a series of spaced rod or bar elements which extend transversely to the direction of movement of the load-transfer device. These transverse rod or bar elements are received in the recesses (31) and are located with respect to the load-transfer device by the location member as the rod or bar members move through the device. Similarly this type of load-transfer device could be used in a system as described in my published British Patent Specification No. 2,049,592A whereby the load-transfer device is engaged with a mesh structure and transverse elements of such structure are received in the recesses (31) of the wheels (30) as the load-transfer device is moved through the mesh.

The components of the load-transfer device may be made of any suitable material, for example a metal, such as stainless steel, or for lighter applications a plastics material may be used.

It will be appreciated that in other embodiments of the invention the pegs or other elements providing the annular series of axial projections, could be fixed in recesses in the respective wheel members without being able to rotate therein. In such embodiments, the projections will be in sliding rather than rolling engagement in the arcuate recesses in the location member.

In the embodiments shown in the drawings, the wire (22) is received in a part-circular groove (32) in the underside of the location member (13*a*). This groove, when viewed in a cross-section may extend over more than half of a circle in order to partly enclose the wire and retain it in the groove and in such embodiments the wheel (80) need not be used. In this way the possibility of detachment of the device from the wire by engagement of the wire under twisting loads in a space between a pair of adjacent projections (18 or 19) and subsequent "winding out" of the load-transfer device as the wheels (11, 12) then rotate relative to the location member (13*a*), is reduced. An end section of the wire (22) may be provided by a smaller diameter wire messenger which can be readily engaged in the groove (32) through its longitudinal open portion; subsequent movement of the load-transfer device along the wire then engages the main larger diameter portion of the wire in the groove.

A load-transfer device according to the present invention may be provided with a load attachment arm extending between the two series of pegs (18, 19) and pivotally mounted at one end on the axle (16), e.g. similar to the connector member (14) of the constructions illustrated in my British Patent Specification No. 2,096,958. This load attachment arm could also be in the form of any of the locking members (14,30,50,54 and 63) illustrated in my British Patent Specification No. 2,096,959, whereby the load-transfer device can be locked to the wire. Moreover load-transfer devices according to the present invention may be provided with latch members, similar to latch members (13,30,40,61,73,74,84) of the devices illustrated in my British Patent Specification No. 2,097,052 which are modified by having arcuate grooves therein to receive the pegs (18,19), so that they can be used for similar applications to those for which the devices of my British Patent Specification No. 2,097,052 may be used. Furthermore load-transfer devices according to the present invention may be used in safety equipment for boats as described in my published British Patent Specification No. 2,024,749A or in systems for location edge portions of sails as described in my published British Patent Specification No. 2,060,532A.

Reference should be made to my U.S. patent applications based on my published British Patent Specification Nos. 2,024,749A, 2,096,958, 2,096,959, 2,097,052, 2,096,957, and 2,060,532A and my British Pat. No. 1,582,201 for fuller details of the systems referred to above, and the disclosures in those specifications are included herein by reference.

Referring to FIGS. 4 to 9, there is shown a load-transfer device which is basically similar to that of FIGS. 1 and 2, in that it comprises a pair of similar rotary members (only one (40) of which is shown), an annular series of axial projections (41) on each rotary member, and a location member (39) disposed between the rotary members and having arcuate tracks (38) on each side thereof in which free end portions of the projections engage so as to allow the rotary members (40) to rotate in use relative to the location member (39) to allow a support or attachment member, e.g. a hanger (42) shaped to embrace the location member (38), to pass through the device.

The axial projections (41) are integrally formed with the associated rotary members (40) and are shaped to have convex arcuate radial side surfaces instead of the cylindrical projections of the embodiment of FIGS. 1 and 2. In this way, the side surfaces have a larger radius of curvature than that of the aforesaid cylindrical projections thereby facilitating rotation of the rotary members when a pair of projections (41) are engaged by a hanger member (42) in the position shown in FIG. 6 whereby the projections must initially be moved in a generally upward direction to reach the position shown in FIG. 7.

A radially inner portion (43) of each projection (41) is recessed as shown in FIG. 5 and the outer portions (44) thereof are received in arcuate tracks (38) in the location member (39) with the lower arcuate flanges thereof engaging in the recessed inner portions (43) of the projections, as shown in FIG. 5.

Each rotary member (40) is provided with a recessed "star" wheel (50) which is freely rotatable on the common axle (49) of the rotary members (40). As shown in FIG. 5 the tip portions of the radial fingers of the wheels (50) have axial protuberances (45) which engage in annular recesses (46) of corresponding form in the rotary members.

The wheels (50) together with cooperating skirts (48) on the location member (39) laterally locate a wire (47) extending through the device between the rotary members. The hangers (42) which slide along the wire pass through the device as illustrated in FIGS. 6 to 9. Each hanger (42) engages a pair of projections on the rotary members and on further movement through the device cause the rotary members (40) to rotate relative to the location member. The hanger has a generally U-shaped portion embracing the location member, the base portion of which engages in a pair of the radial recesses in the star wheels which then rotate with the rotary members. The hanger then disengages from the star wheels and causes the pair of projections, against which it acts during passage through the device, to move downwardly to allow the hanger to move over those projections to disengage from the device. As explained above the shape of the projections facilitates rotation of the rotary movements by the engagement of the hanger members with the projections during which the hanger members move along a generally linear path whereas the projections move along an arcuate path.

In other embodiments, the two star wheels (50) may be parts of a single member or assembly having a hub portion joining together the star wheels and rotatably mounted on the axle (49).

A plurality of load-transfer devices as described above can be used for example in a fastening device as disclosed in my British Patent Specification No. 2,101,058, e.g in place of the load-transfer device having cylindrical projections as illustrated in FIG. 2 of that Application.

Figure 10:
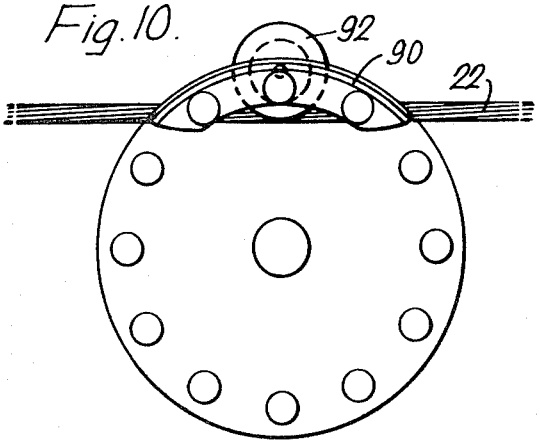
FIG. 10 is a detail of further embodiment having a rolling element on the guide member thereof.

The embodiment shown in FIG. 10 is generally similar to that shown in FIGS. 1 and 2, except that the guide member (90) is provided with one or more freely running wheels or rollers (92) (one being shown in FIG. 10) to contact the elongate member (22) so as to reduce friction between the guide member (90) and the elongate member (22).

I claim:

1. A load-transfer system comprising:

an elongate element;

a plurality of U-shaped mounting elements supporting said elongate element at spaced locations along its length; and a load-transfer device comprising:

(a) a pair of spaced apart rotary members mounted for rotation about a common axis, (b) an annular series of generally evenly spaced projections on each of said members encircling said common axis, the projections on one member extending towards the projections on the other member.

(c) a location element having at least a portion disposed between and spaced from said rotary members to contact said elongate element for movement therealong, opposite side faces of said portion being formed with arcuate tracks to receive and locate tip portions only of said projections so that, when the load-transfer device moves along the elongate element and encounters a mounting element thereof, the parallel limbs of the U-shaped mounting element abut portions of respective projections of the rotary members which then rotate with respect to said location element to allow the load-transfer device to transverse said mounting element with said pair of parallel limbs of the mounting element extending one on each side of said location element and with each of said parallel limbs extending through a space defined between an adjacent pair of said projections, the corresponding rotary member and the location element.

2. A load-transfer device according to claim 1 wherein said projections are provided by cylindrical elements which are mounted on the rotary members respectively for free rotation so that they act as rolling elements to facilitate movement through the corresponding arcuate tracks on the location element, which are generally provided by arcuate grooves formed in opposite side surfaces thereof.

3. A load-transfer device according to claim 1 in which said projections are fixed with respect to, or integrally formed with, the respective rotary members and are shaped to have generally convex radial side surfaces.

4. A load-transfer device according to claim 3, wherein each projection has the form of a double convex lens, namely generally lentil shaped.

5. A load-transfer device according to claim 1, wherein the rotary members are generally disc-like elements.

6. A load-transfer device according to claim 5, wherein the disc-like elements have recesses formed in their peripheries between each pair of adjacent projections thereof to accommodate transverse support elements.

7. A load-transfer device according to claim 1, wherein the underside of the location element is formed with a part-circular recess which when viewed in cross-section extends over more than half a circle for receiving and locating an elongate element.

8. A load-transfer device according to claim 1, having a rotary recessed wheel mounted on said common axis in the same plane as said location element and having an evenly spaced series of radial projections for engaging an elongate element extending in use through the device and locating it against the underside of the location element.

9. A load-transfer device according to claim 8 wherein said radial projections are smoothly curved to converge towards said tips thereof such that said wheel is self-indexing in use when engaged by a transverse support element of said elongate element.

10. A load-transfer device according to claim 1, having a pair of recessed wheel parts rotatably mounted on said common axis between said rotary members, the wheel parts each having an evenly spaced series of radial projections and the wheel parts being spaced from one another to define, with said location element, a channel in which an elongate element extending in use through the device, is contained.

11. A load-transfer device according to claim 1, wherein a radially inner portion of each of said projections is recessed with the remaining radially outer portion thereof being received in a corresponding arcuate track provided in the location element.

12. A load-transfer device according to claim 1, including on the location element at least one free-running rolling element mounted so that its perimeter contacts in use an elongate element which passes in use through the device generally along the underside of the location element.

* * * * *